US007699395B1

(12) United States Patent
Bozarth et al.

(10) Patent No.: US 7,699,395 B1
(45) Date of Patent: Apr. 20, 2010

(54) HIGH CHAIR APPARATUS

(76) Inventors: John V. Bozarth, 25 Chalet Hills Ter., Henderson, NV (US) 89052; Erica L. Bozarth, 25 Chalet Hills Ter., Henderson, NV (US) 89052

( * ) Notice: Subject to any disclaimer, the term of this patent is extended or adjusted under 35 U.S.C. 154(b) by 0 days.

(21) Appl. No.: 12/335,281

(22) Filed: Dec. 15, 2008

(51) Int. Cl.
*A47C 7/62* (2006.01)

(52) U.S. Cl. ..... 297/217.3; 297/188.08; 15/323

(58) Field of Classification Search ..... 297/188.01, 297/188.08, 188.09, 217.3; 15/301, 323, 15/327.2
See application file for complete search history.

(56) References Cited

U.S. PATENT DOCUMENTS

| | | | | | |
|---|---|---|---|---|---|
| 2,367,437 | A * | 1/1945 | Salt | 297/217.3 |
| 2,603,816 | A * | 7/1952 | MacFarland | 297/462 |
| 2,885,714 | A * | 5/1959 | Johnson | 297/217.3 |
| 3,994,042 | A | 11/1976 | Zakis | |
| 3,994,528 | A * | 11/1976 | Humphrey | 297/182 |
| 4,165,123 | A | 8/1979 | Hutson | |
| D283,956 | S | 5/1986 | Lemmeyer | |
| 4,594,747 | A | 6/1986 | Dempsey | |
| 5,095,579 | A * | 3/1992 | Becker | 15/339 |
| 5,205,013 | A * | 4/1993 | Lopes | 15/301 |
| 6,109,688 | A * | 8/2000 | Wurz et al. | 297/180.14 |
| 6,675,436 | B1 | 1/2004 | Fratoni, Jr. | |
| 6,928,691 | B2 | 8/2005 | Freeman | |
| 7,472,455 | B2 * | 1/2009 | Dolton | 15/323 |

FOREIGN PATENT DOCUMENTS

EP 1190648 * 3/2002

* cited by examiner

*Primary Examiner*—Peter R. Brown
(74) *Attorney, Agent, or Firm*—Crossley Patent Law; Mark A. Crossley

(57) ABSTRACT

The high chair apparatus focuses on safety by providing no sharp edges. External edges and features of the apparatus are rounded to avoid potential injury to a child, whether in or around the apparatus. The seat prevents a child's escape from the chair via the harness and the divider. The built-in vacuum has a substantially selectively hidden hose so that the hose is out of the way except during use. The hose extends sufficiently to clean the apparatus and any area around the apparatus. The removable tray cover and chair back cover further aid in cleanup by providing removable washability. The pedestal housing the vacuum components is insulated to negate excessive noise. Triangularly positioned wheels provide mobility.

2 Claims, 6 Drawing Sheets

100
10
110
84
76
86
34
56
38
58
110

HIGH CHAIR APPARATUS

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

High chairs for infants and toddlers are well known in the arts. It is also well known that young ones typically make a mess when eating in them. What has been needed is a high chair that is designed for safety as well as ease of cleanup. The present apparatus provides such, along with a built-in vacuum for total chair and surrounding area cleanup.

FIELD OF THE INVENTION

The high chair apparatus relates to high chairs for children and more especially to an especially safe high chair which houses a vacuum for cleanup and provides few surfaces for mess accumulation.

SUMMARY OF THE INVENTION

The general purpose of the high chair apparatus, described subsequently in greater detail, is to provide a high chair apparatus which has many novel features that result in an improved high chair apparatus which is not anticipated, rendered obvious, suggested, or even implied by prior art, either alone or in combination thereof.

To attain this, the high chair apparatus focuses on safety by providing no sharp edges. External edges and features of the apparatus are rounded to avoid potential injury to a child, whether in or around the apparatus. The seat prevents a child's escape from the chair via the harness and the divider. The built-in vacuum has a substantially selectively hidden hose so that the hose is out of the way except during use. The hose extends sufficiently to clean the apparatus and any area around the apparatus. The removable tray cover and chair back cover further aid in cleanup by providing removable washability. The pedestal housing the vacuum components is insulated to negate excessive noise. Triangularly positioned wheels provide mobility.

Thus has been broadly outlined the more important features of the improved high chair apparatus so that the detailed description thereof that follows may be better understood and in order that the present contribution to the art may be better appreciated.

An object of the high chair apparatus is to provide for easy cleanup.

Another object of the high chair apparatus is to provide a built-in vacuum to aid in cleanup.

A further object of the high chair apparatus is to provide a vacuum hose which is selectively hidden when not in use.

An added object of the high chair apparatus is to operate as quietly as possible.

And, an object of the high chair apparatus is to provide for a child's safety.

These together with additional objects, features and advantages of the improved high chair apparatus will be readily apparent to those of ordinary skill in the art upon reading the following detailed description of presently preferred, but nonetheless illustrative, embodiments of the improved high chair apparatus when taken in conjunction with the accompanying drawings.

In this respect, before explaining the current embodiments of the improved high chair apparatus in detail, it is to be understood that the high chair apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved high chair apparatus. It is therefore important that the claims be regarded as including such equivalent constructions insofar as they do not depart from the spirit and scope of the high chair apparatus. It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 6 thereof, the principles and concepts of the high chair apparatus generally designated by the reference number 10 will be described.

Figure 6:
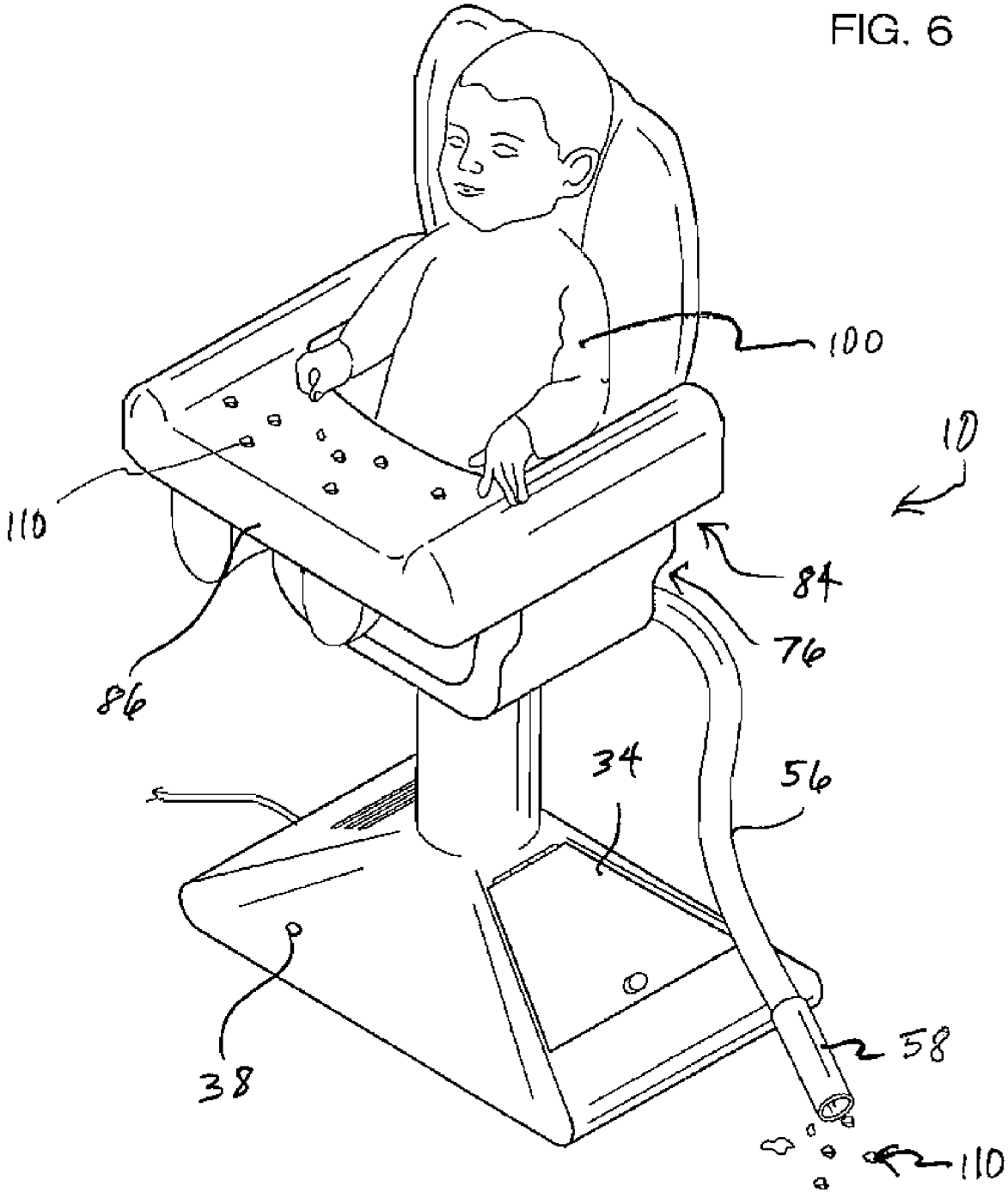
FIG. 6 is a perspective view of the apparatus in use.

Referring to FIG. 6, the apparatus 10 provides a safe high chair for a child 100. The removable tray 84 is disposed under the removable tray cover 86 which can be placed in a dishwasher for washing. The flexible vacuum hose 56 is tipped with a nozzle 58 and provides for cleanup of food 110 from any part of the apparatus 10 or an area thereabout.

Figure 3:
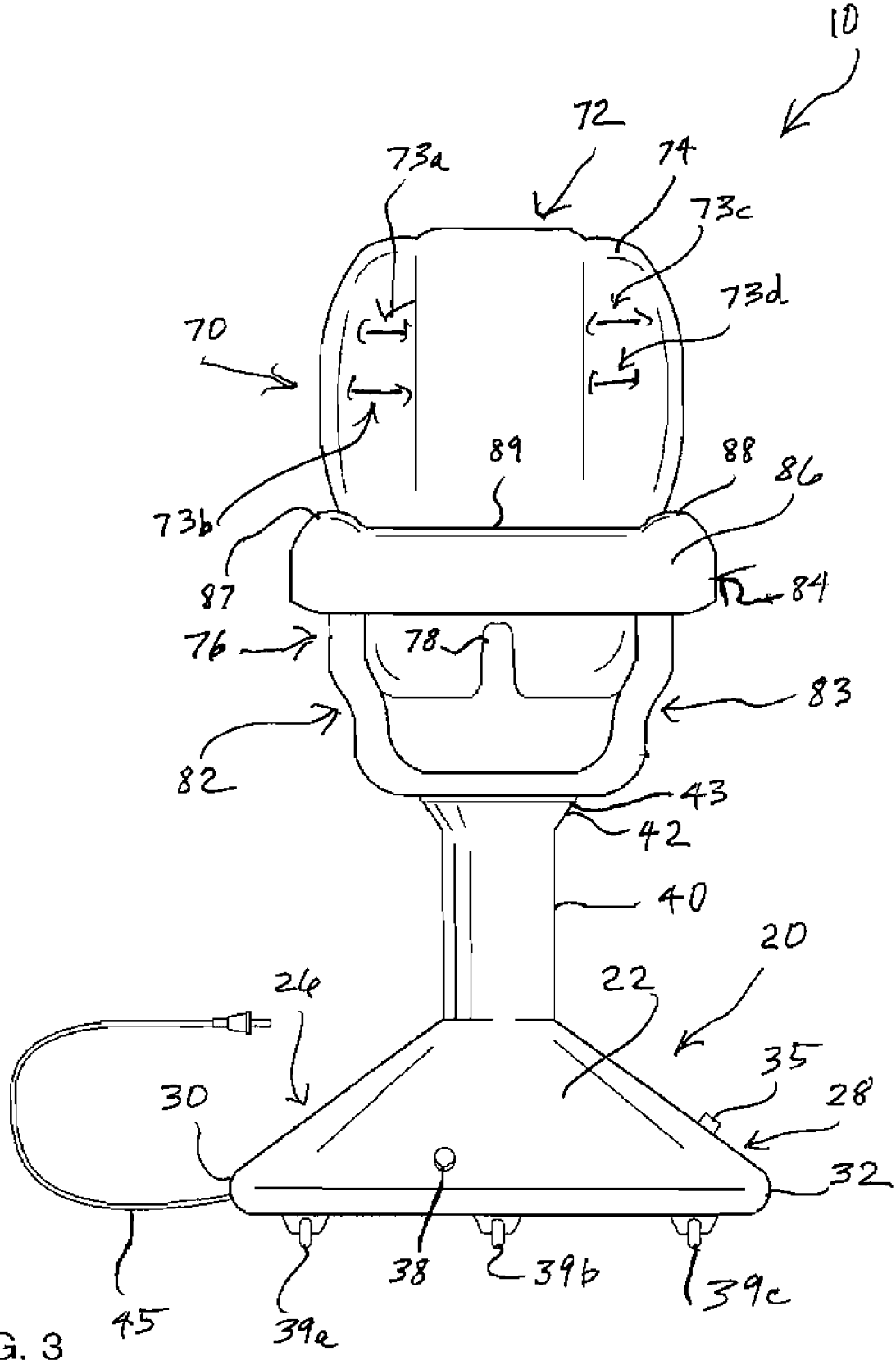
FIG. 3 is a front elevation view.
Figure 4:
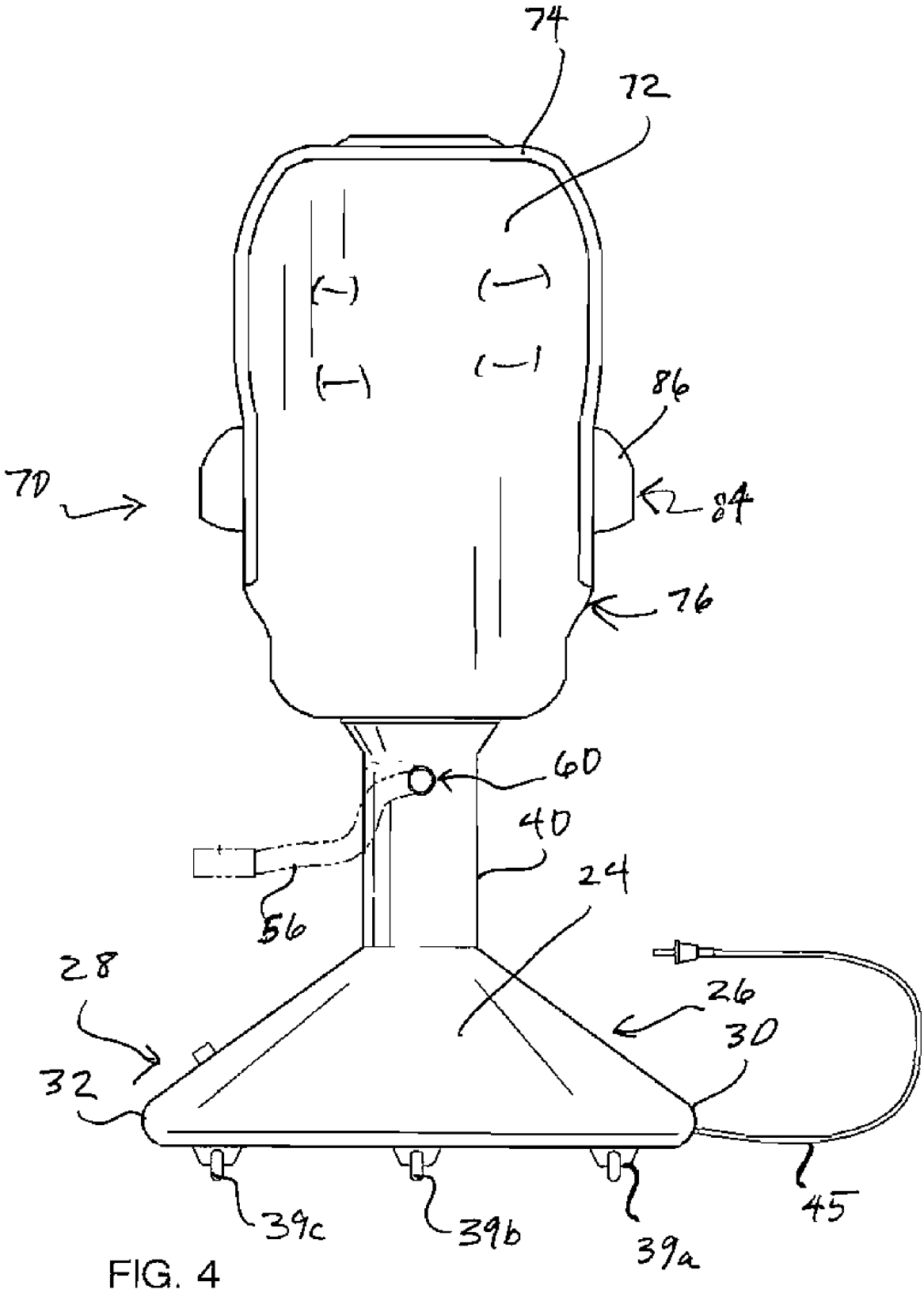
FIG. 4 is a rear elevation view.

Referring to FIGS. 3 and 4, the high chair apparatus 10 partially comprises a pyramidal pedestal 20 that has a front 22 spaced apart from a back 24, and a first side 26 spaced apart from a second side 28. The first rounded edge 30 is disposed at the bottom of the first side 26. The second rounded edge 32 is disposed at the bottom of the second side 28. The rounded edges and the other multitude of rounded surfaces of the apparatus 10 are important in ensuring that a child cannot be caught or injured when in or around the apparatus 10. The trio of spaced apart wheels is disposed triangularly on the pedestal 20 bottom. The wheels comprise the first wheel 39*a*, the second wheel 39*b*, and the third wheel 39*c*. The exhaust vent 36 is disposed within the first side 26. The foot switch 38 is disposed on the front 22. The retractable power cord 45 is disposed within the first side 26.

Figure 5:
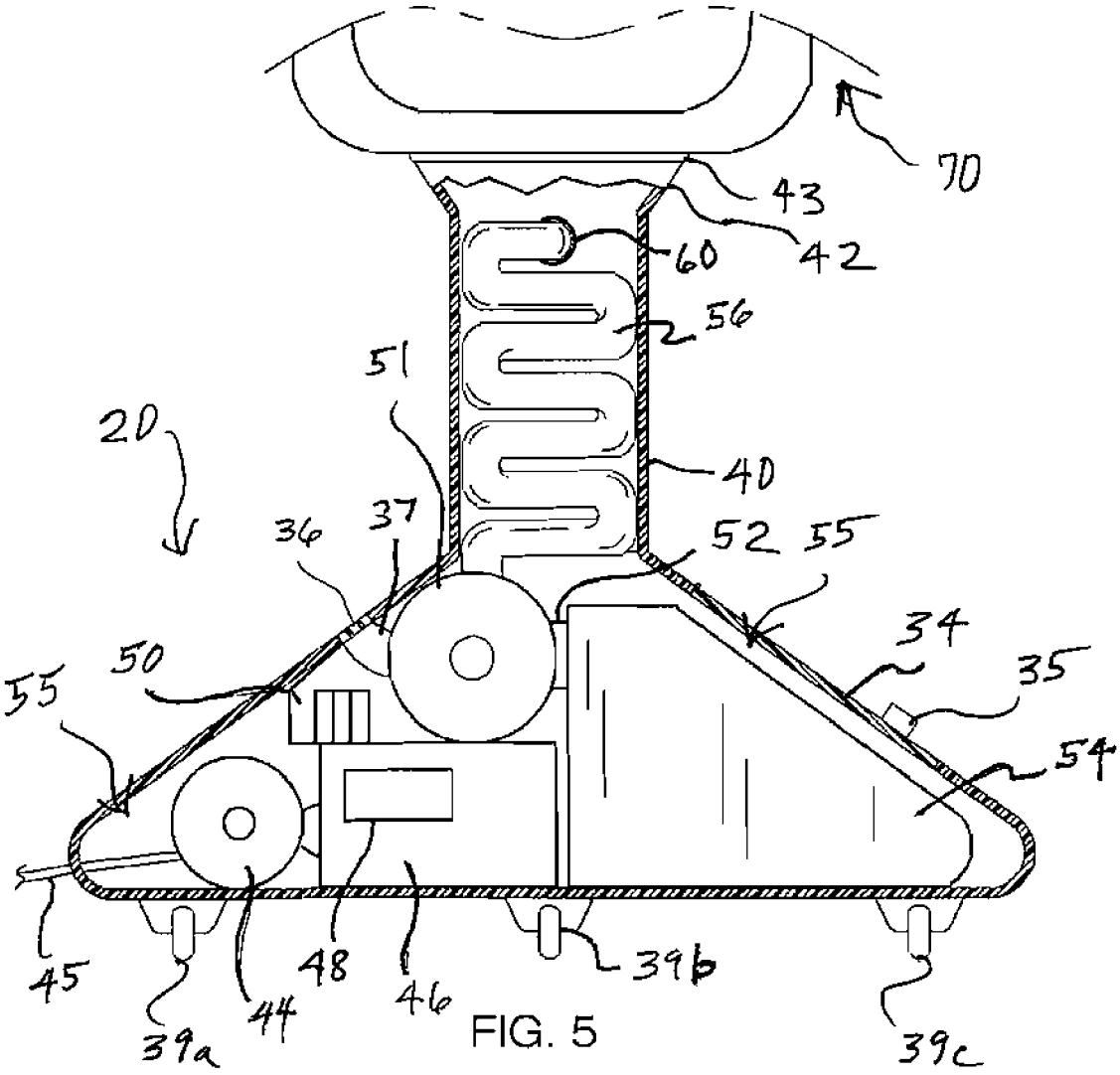
FIG. 5 is a partial frontal cross sectional view.

Referring to FIG. 5, the vacuum motor 46 is disposed within the pedestal 20. The vacuum motor 46 is in communication with the power cord 45 and the foot switch 38. The surge protector 48 is within the pedestal 20, proximal to the vacuum motor 46. The surge protector 48 is in communication with the power cord 45. The vacuum compartment 50 is disposed above the vacuum motor 46 within the pedestal 20. The vacuum canister 51 is within the vacuum compartment 50. The vacuum exhaust 37 is in communication with the canister 51 and the exhaust vent 36. The removable trash compartment 54 is disposed within the pedestal 20. The trash compartment 54 is in communication with the vacuum canister 51 via the transfer hose 52. Insulation 55 surrounds the interior of the pedestal 20, thereby quieting sounds generated by the vacuum components. The cord reel 44 provides retractability for the power cord 45.

Figure 1:
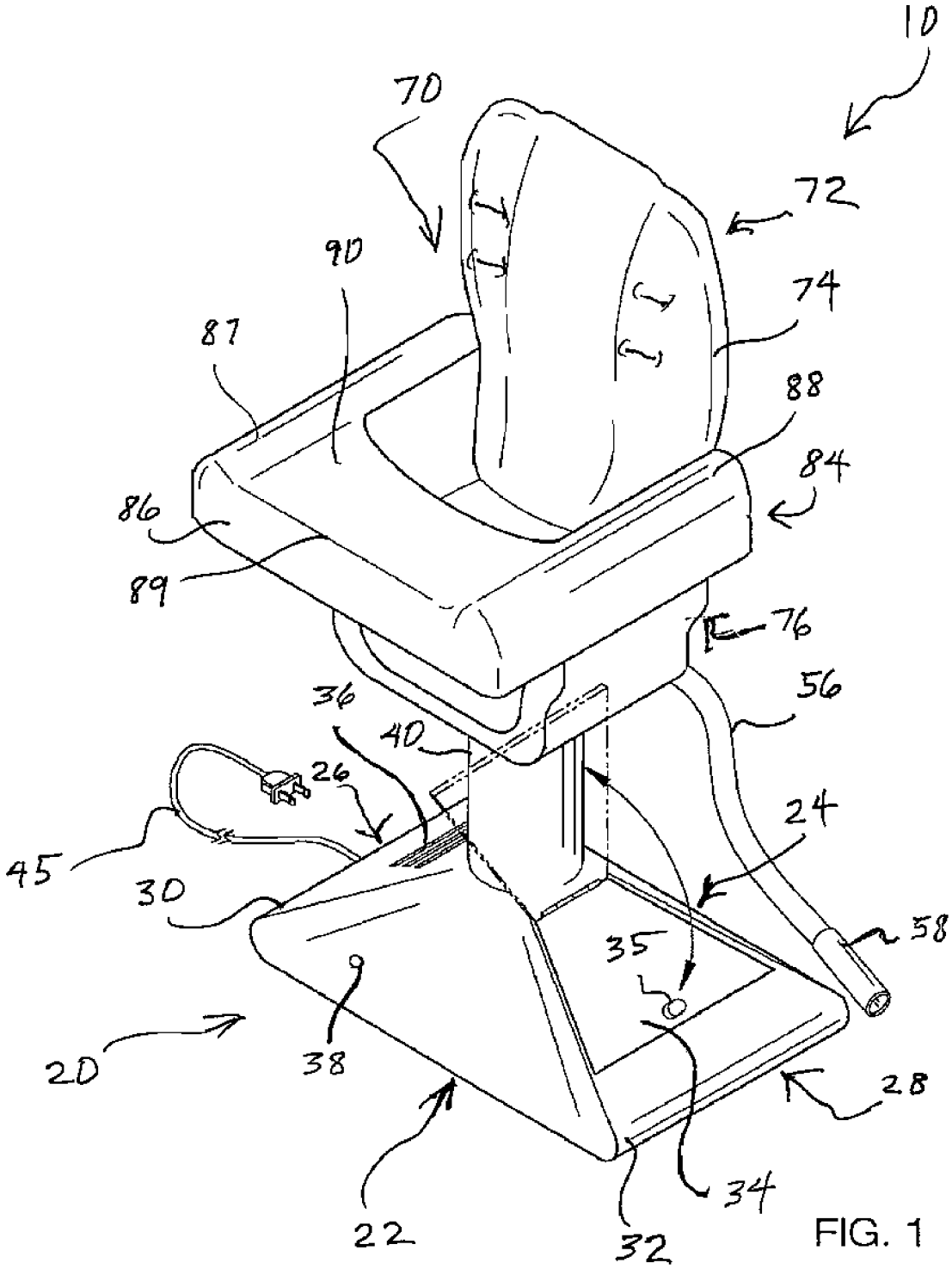
FIG. 1 is a frontal perspective view.
Figure 2:
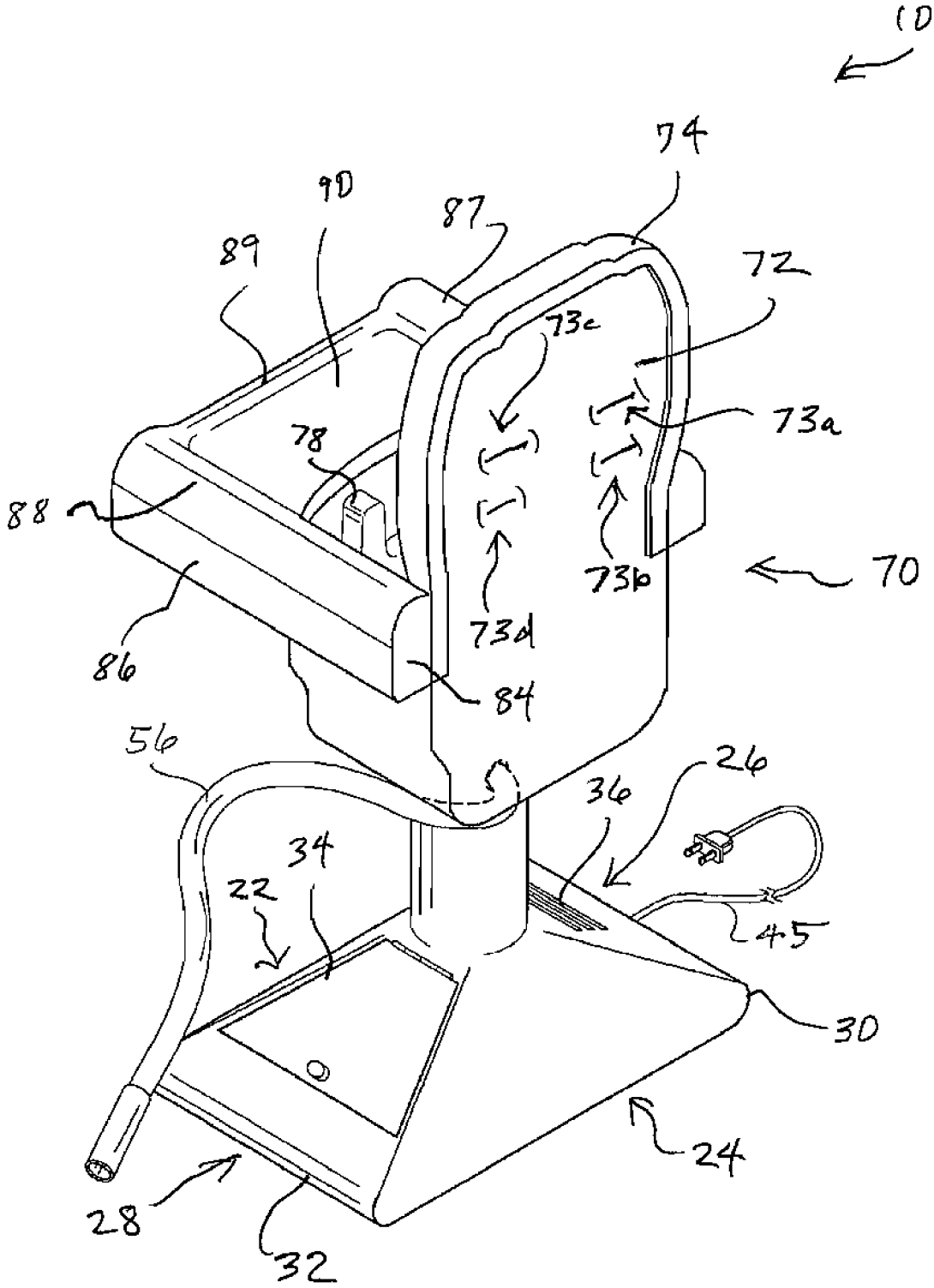
FIG. 2 is a rear perspective view.

Referring to FIGS. 1 and 2 and continuing to refer to FIG. 5, the hinged door 34 is disposed within the second side 28. The door 34 is disposed above the trash compartment 54. The cylinder 40 is disposed atop the pedestal 20. The flexible substantially removable vacuum hose 56 is selectively stored within the cylinder 40. The vacuum hose 56 is in communication with the canister 51. The vacuum hose 56 is fitted within the orifice 60 of the cylinder 40. The flare 42 is disposed atop the cylinder 40. The mount plate 43 is disposed atop the flare 42. The chair 70 is disposed atop the mount plate 43. The mount plate 43 importantly spreads the chair 70 mounting to ensure against failure of the joining of the chair 70 and plate 43.

Referring again to FIGS. 1, 2, and 3, the chair 70 comprises the seat 76 affixed to the back 72. The divider 78 is vertically disposed in the bottom front of the seat 76 and prevents a child 100 from sliding forward or out of the chair 70. The scalloped reductions are disposed in each side of the seat 76 bottom and comprise the first scalloped reduction 82 and the second scalloped reduction 83. The scalloped reductions are smoothly transitioned to avoid any abrupt edges. The removable cover 74 is disposed on the chair 70 back 72. The removable cover 74 is thereby easily washed. The plurality of harness slots is disposed within the chair back 72 and cover 74. The slots comprise the first slot 73*a*, the second slot 73*b*, the third slot 73*c*, and the fourth slot 73*d*. A harness (not shown) is provided for fit within the appropriate slots for restraining a given sized child 100 against potentially climbing out of the chair 70. The removable tray 84 is disposed above the seat 76. The removable tray cover 86 is disposed on the tray 84. The tray cover 86 partially comprises the first rounded elevation 87 spaced apart from the second rounded elevation 88. The front elevation 89 connects the front of each of the first elevation 87 and the second elevation 88. The recession 90 is disposed between the elevations. The tray cover 86 thereby prevents many food 110 spills which otherwise might occur.

With respect to the above description then, it is to be realized that the optimum dimensional relationships for the parts of the high chair apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the high chair apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the high chair apparatus may be used.

Therefore, the foregoing is considered as illustrative only of the principles of the high chair apparatus. Further, since numerous modifications and changes will readily occur to those skilled in the art, it is not desired to limit the high chair apparatus to the exact construction and operation shown and described, and accordingly, all suitable modifications and equivalents may be resorted to, falling within the scope of the high chair apparatus.

What is claimed is:

1. A high chair apparatus, comprising, in combination:
- a pyramidal pedestal having a front spaced apart from a back, a first side spaced apart from a second side;
- a first rounded edge at a bottom of the first side;
- a second rounded edge at a bottom of the second side;
- a trio of spaced apart wheels disposed triangularly on the pedestal bottom, comprising a first wheel, a second wheel, and a third wheel;
- an exhaust vent disposed within the first side;
- a foot switch disposed on the front;
- a retractable power cord disposed within the first side;
- a vacuum motor within the pedestal, the vacuum motor in communication with the power cord and the foot switch;
- a vacuum compartment disposed above the vacuum motor within the pedestal;
- a vacuum canister within the vacuum compartment;
- a vacuum exhaust in communication with the canister and the exhaust vent;
- an insulation within the pedestal;
- a removable trash compartment disposed within the pedestal, the trash compartment in communication with the vacuum canister via a transfer hose;
- a hinged door disposed within the second side, the door above the trash compartment;
- a cylinder disposed atop the pedestal;
- a flexible substantially removable vacuum hose selectively stored within the cylinder, the vacuum hose in communication with the canister, the vacuum hose fitted within an orifice of the cylinder;
- a flare disposed atop the cylinder;
- a mount plate disposed atop the flare;
- a chair disposed atop the mount plate, the chair comprising:
  - a seat affixed to a back;
  - a divider vertically disposed in a bottom front of the seat;
  - a scalloped reduction disposed in an each side of the seat bottom, comprising a first scalloped reduction and a second scalloped reduction;
  - a removable cover disposed on the chair back;
  - a plurality of harness slots disposed within the chair back and removable cover, the slots comprising a first slot, a second slot, a third slot, and a fourth slot;
  - a removable tray disposed above the seat;
  - a removable tray cover disposed on the tray.

2. A high chair apparatus, comprising, in combination:
- a pyramidal pedestal having a front spaced apart from a back, a first side spaced apart from a second side;
- a first rounded edge at a bottom of the first side;
- a second rounded edge at a bottom of the second side;
- a trio of spaced apart wheels disposed triangularly on the pedestal bottom, comprising a first wheel, a second wheel, and a third wheel;
- an exhaust vent disposed within the first side;
- a foot switch disposed on the front;
- a retractable power cord disposed within the first side;
- a vacuum motor within the pedestal, the vacuum motor in communication with the power cord and the foot switch;
- a surge protector within the pedestal, the surge protector in communication with the power cord;
- a vacuum compartment disposed above the vacuum motor within the pedestal;
- a vacuum canister within the vacuum compartment;

a vacuum exhaust in communication with the canister and the exhaust vent;

an insulation within the pedestal;

a removable trash compartment disposed within the pedestal, the trash compartment in communication with the vacuum canister via a transfer hose;

a hinged door disposed within the second side, the door above the trash compartment;

a cylinder disposed atop the pedestal;

a flexible substantially removable vacuum hose selectively stored within the cylinder, the vacuum hose in communication with the canister, the vacuum hose fitted within an orifice of the cylinder;

a flare disposed atop the cylinder;

a mount plate disposed atop the flare;

a chair disposed atop the mount plate, the chair comprising:

a seat affixed to a back;

a divider vertically disposed in a bottom front of the seat;

a scalloped reduction disposed in an each side of the seat bottom, comprising a first scalloped reduction and a second scalloped reduction;

a removable cover disposed on the chair back;

a plurality of harness slots disposed within the chair back and removable cover, the slots comprising a first slot, a second slot, a third slot, and a fourth slot;

a removable tray disposed above the seat;

a removable tray cover disposed on the tray, the tray cover partially comprising:

a first rounded elevation spaced apart from a second rounded elevation;

a front elevation connecting a front of each of the first elevation and the second elevation;

a recession disposed between the elevations.

* * * * *